US007047587B2

(12) United States Patent
Heidel

(10) Patent No.: US 7,047,587 B2
(45) Date of Patent: May 23, 2006

(54) LINT ROLLER HOLDER ASSEMBLY

(75) Inventor: Lena L. Heidel, Dunwoody, GA (US)

(73) Assignee: The Evercare Company, Alpharetta, GA (US)

( * ) Notice: Subject to any disclaimer, the term of this patent is extended or adjusted under 35 U.S.C. 154(b) by 32 days.

(21) Appl. No.: 10/800,542

(22) Filed: Mar. 15, 2004

(65) Prior Publication Data

US 2005/0198756 A1 Sep. 15, 2005

(51) Int. Cl.
*A47L 25/00* (2006.01)

(52) U.S. Cl. ..... 15/104.002; 15/230.11; 15/144.1; 15/144.4; 492/13

(58) Field of Classification Search ..... 15/27, 15/104.002, 230.11, 144.1, 144.4; 16/429; 492/13, 14, 19

See application file for complete search history.

(56) References Cited

U.S. PATENT DOCUMENTS 1,951,023 A * 3/1934 Winsor ..... 15/244.1
2,641,012 A * 6/1953 Storrs ..... 15/144.4
2,883,692 A * 4/1959 Kaye et al. ..... 15/184
3,942,540 A * 3/1976 Gause ..... 132/313
4,135,274 A * 1/1979 Freeman ..... 15/244.1
4,399,579 A * 8/1983 McKay ..... 15/104.002
4,422,201 A * 12/1983 McKay ..... 15/104.002
4,639,965 A * 2/1987 Suzuki ..... 15/104.002
5,479,951 A * 1/1996 Denebeim ..... 132/265
5,940,921 A * 8/1999 Wood et al. ..... 15/104.002
6,055,695 A 5/2000 McKay, Jr. ..... 15/104.002
D466,696 S * 12/2002 Van Dyk ..... D4/121

* cited by examiner

*Primary Examiner*—Gary K. Graham
(74) *Attorney, Agent, or Firm*—Gifford, Krass, Groh, Sprinkle, Anderson & Citkowski, P.C.

(57) ABSTRACT

A lint roller holder assembly having a lint roller support with an outer cylindrical surface. The lint roller support is dimensioned so that a tubular and cylindrical lint roller may be rotatably supported around the outer surface of the lint roller support. An elongated handle is axially slidably mounted to the lint roller support between a first position and a second position. In its first position, the handle extends axially outwardly from one end of the lint roller support when use of the lint roller assembly is desired. Conversely, in its second position, the handle is at least partially contained within the interior of the lint roller support for compact storage, display and/or transportation.

11 Claims, 3 Drawing Sheets

10
28
3
3
22
16
12
18
20
14

56
12
22
24
16
10
18
20
14

20
16
28
22

LINT ROLLER HOLDER ASSEMBLY

BACKGROUND OF THE INVENTION

I. Field of the Invention

The present invention relates generally to a lint roller holder assembly.

II. Description of Related Art

Lint roller assemblies have been long used for removing detritus from clothing as well as other surfaces. These previously known lint roller assemblies typically comprise a lint roller holder on which a tubular and cylindrical lint roller is rotatably mounted.

These previously known lint roller holder assemblies typically comprise a tubular and cylindrical lint roller support on which the lint roller is rotatably supported. A handle portion typically extends outwardly from one end of the lint roller holder support so that the handle may be grasped by the user in order to easily roll the lint roller along the surface to be cleaned.

These previously known lint roller holder assemblies are typically of molded plastic construction for both low manufacturing cost as well as durability in use. Typically, the lint roller holder assembly is formed in two plastic sections wherein each section includes a semicircular roller support portion and a handle portion. The sections are snapped together in a facing relationship and, in doing so, the two sections of the handle simultaneously form the cylindrical lint roller support as well as the handle which extends axially outwardly from one end of the lint roller support.

While these previously known lint roller assemblies have proven entirely satisfactory in operation, such lint roller assemblies are necessarily somewhat bulky in construction. As such, such lint roller assemblies have not proven wholly satisfactory where a small or compact size for the lint roller assembly is desired, such as when the lint roller assembly is packed in a travel bag or on display in a retail establishment.

SUMMARY OF THE PRESENT INVENTION

The present invention provides a lint roller holder assembly which overcomes all of the above-mentioned disadvantages of the previously known devices.

In brief, the lint roller holder assembly comprises a lint roller support having an outer cylindrical surface. The lint roller support is dimensioned to rotatably receive and support a lint roller. Such lint rollers are typically disposable so that, after the lint roller has been depleted, it is removed from the lint roller support and replaced by a new lint roller.

The lint roller holder assembly further includes an elongated handle which is axially slidably mounted to the lint roller support between a first position and a second position. In its first position, the handle extends axially outwardly from one end of the lint roller support such that the handle may be easily grasped by the user when use of the lint roller assembly is desired. Conversely, in its second position, the handle is at least partially retracted into the interior of the lint roller support for compact storage, retail display and/or transportation.

The lint roller support preferably includes at least one flexible locking tab which engages the portion on the handle when it is in its first position. In doing so, the locking tab retains the handle in its first or extended position during the use of the lint roller assembly. When use of the lint roller assembly is no longer required, the handle is simply axially pushed into the interior of the lint roller support thus disengaging the locking tab from the handle and allowing the handle to be moved to its second or retracted position.

Preferably, the lint roller support is constructed of two semicircular and substantially identical sections which are simply snapped together to form the lint roller support. Similarly, the handle is also preferably formed in two substantially identical sections which are also snapped together in order to form the handle

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2, 3:
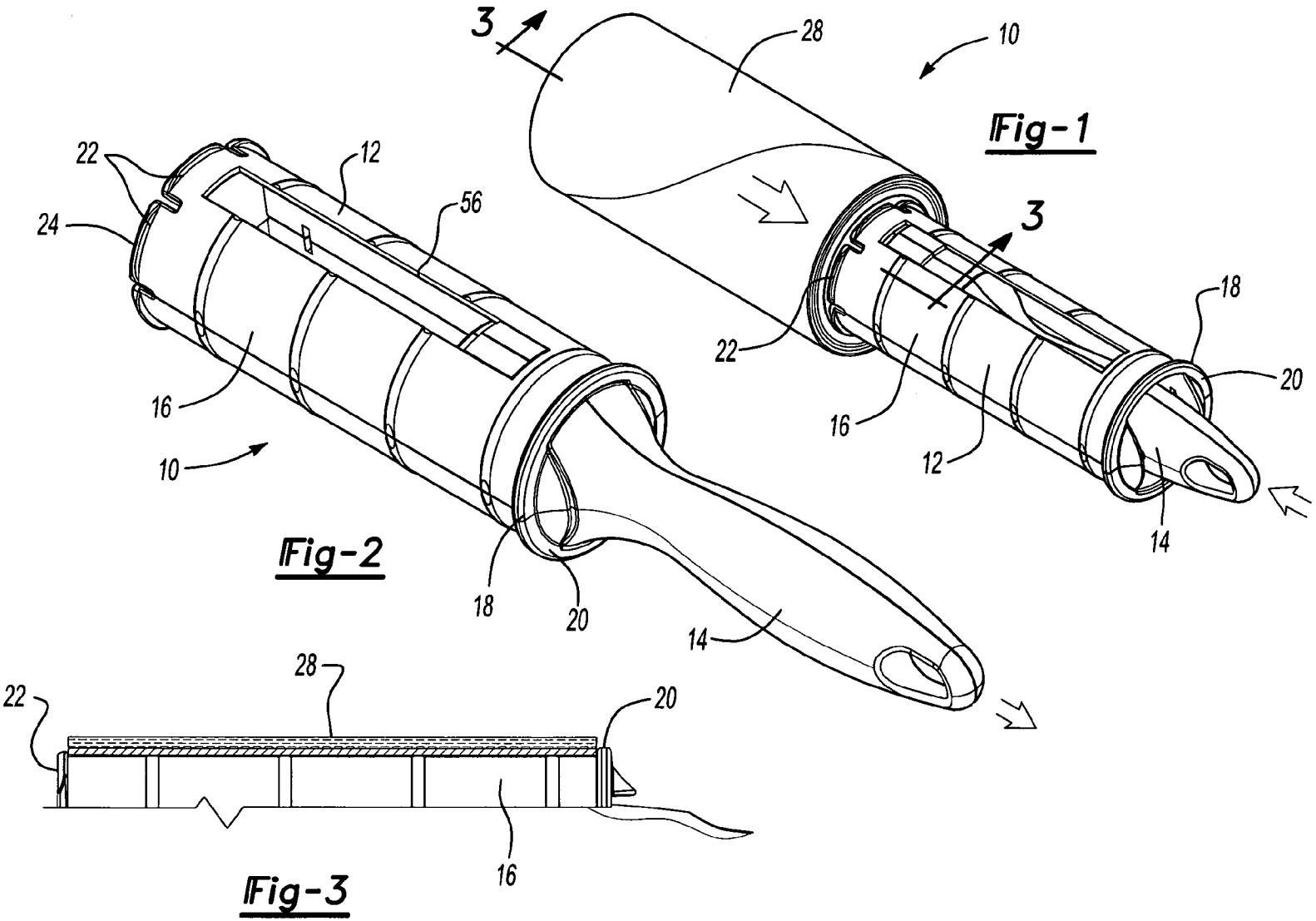
FIG. 1 is an elevational view illustrating a preferred embodiment of the present invention with a lint roller attached.
FIG. 2 is a view similar to FIG. 1, but with the lint roller removed.
FIG. 3 is a fragmentary sectional view taken along line 3—3 in FIG. 1.

With reference first to FIGS. 1 and 2, a preferred embodiment of the lint roller holder assembly 10 of the present invention is shown. The lint roller holder assembly 10 includes both a lint roller support 12 and a handle 14.

The lint roller support 12 is elongated and includes outer cylindrical surface 16. An outwardly extending annular lip 18 is formed at one end 20 of the roller support 12 while a plurality of radially flexible fingers 22 are provided at the opposite end 24 of the roller support 16.

With reference to FIGS. 1 and 3, both the lip 18 and flexible fingers 22 protrude radially outwardly from the cylindrical surface 16 on the roller support 12. Furthermore, the cylindrical surface 16, lip 18 and fingers 22 are all dimensioned to entrap a tubular and cylindrical lint roller 28 on the lint roller support 12. In doing so, the lint roller 28 is rotatably supported around the lint roller support 12.

Figures 4, 4A:
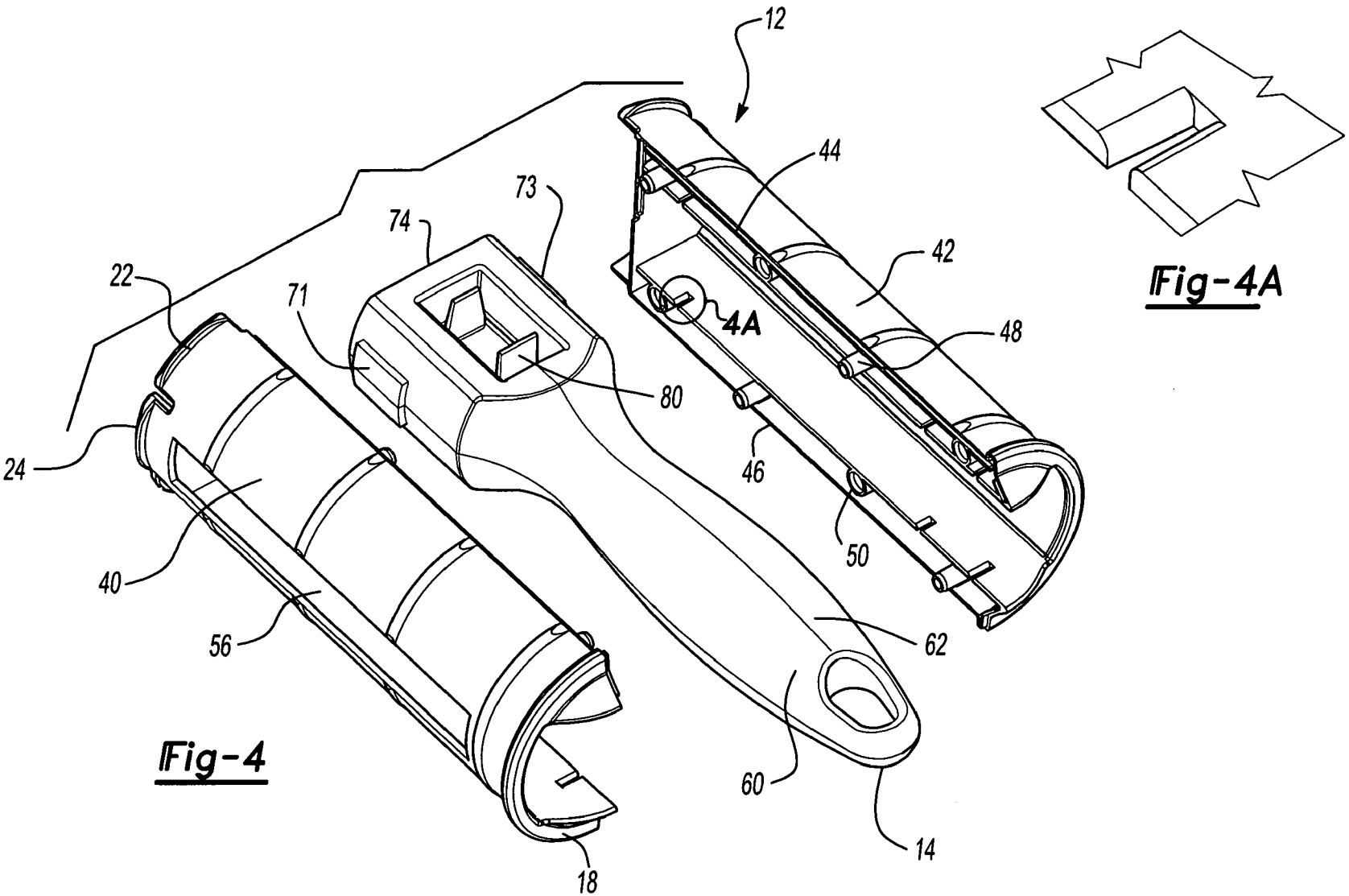
FIG. 4 is an exploded view of the preferred embodiment of the invention.
FIG. 4A is a fragmentary view of a component of the present invention.

With reference now particularly to FIG. 4, the lint roller support 12 is preferably made in two sections 40 and 42, each of which are substantially identical to the other. As such, each section 40 and 42 is substantially semicircular in shape thus having two spaced apart side edges 44 and 46. At least one pin 48 is formed adjacent one side 44 while, similarly, at least one socket 50 is formed adjacent the opposite side 46. Furthermore, these pins 48 and sockets 50 are positioned so that, with the lint roller support handles in a facing position relative to each other, the lint roller holder sections 40 and 42 may be snapped together to form the cylindrical lint roller support 12. Preferably, the lint roller support sections 40 and 42 are of a one-piece plastic construction.

With reference now particularly to FIGS. 2 and 4, with the lint roller support sections 40 and 42 secured together, a pair of axially extending slots 56 (only one shown) are formed along the lint roller support 12 so that the slots 56 are diametrically opposed from each other. Each slot 56, furthermore, extends from a position just short of the lip 18 on the lint roller support 12 and also just short of the end 24.

Figure 5:
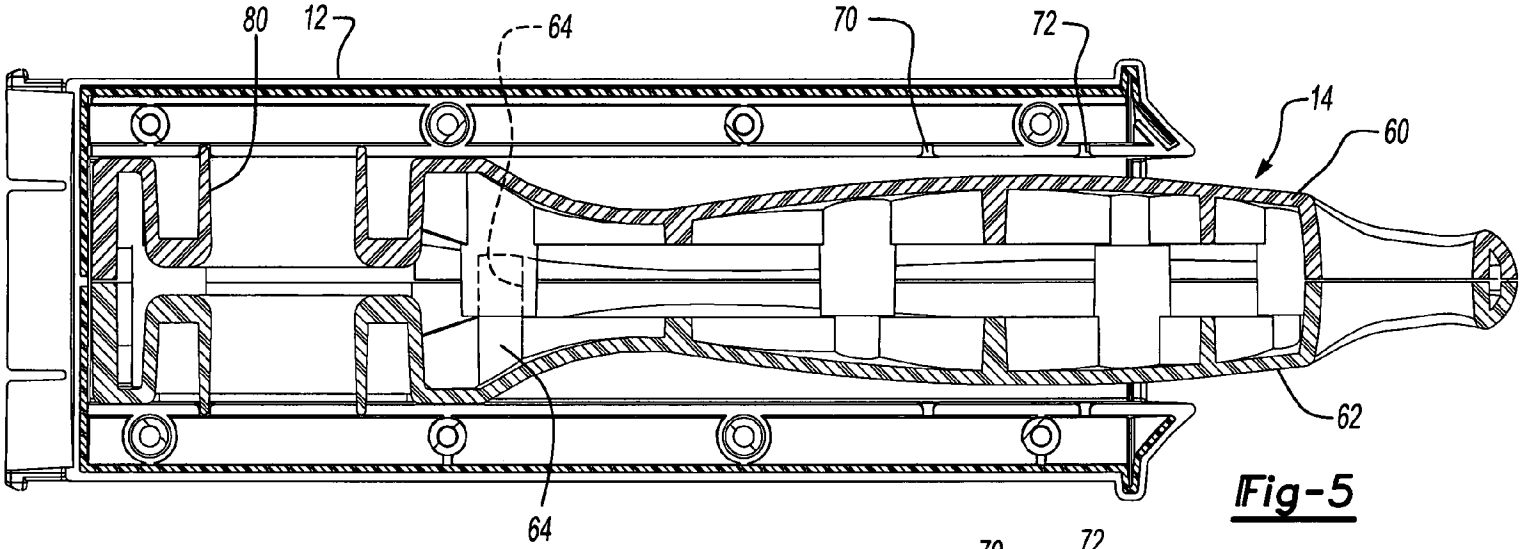
FIG. 5 is a fragmentary longitudinal sectional view illustrating the handle in its second or retracted position.

With reference now to FIGS. 4 and 5, the handle 12 is there shown in greater detail and comprises a pair of substantially identical sections 60 and 62 which are secured together to form the handle 14. Like the lint roller support 12, each handle section 60 and 62 includes at least one pin 64 (FIG. 5) and at least one socket 66. When the handle sections 60 and 62 are in the facing relationship as illustrated in FIG. 5, the pins 64 register with a corresponding socket 66 which enables the handle sections 60 and 62 to be snapped together to form the handle 14. Preferably, the handle sections 60 and 62 are made of plastic.

As best shown in FIG. 4, the handle 14 includes a pair of outwardly extending guides 71 and 73 adjacent one end 74 of the handle 14. These guides 70 and 72, furthermore, are axially slidably received within the slots 56 and 58, respectively, on the lint roller support 12.

Figure 6:
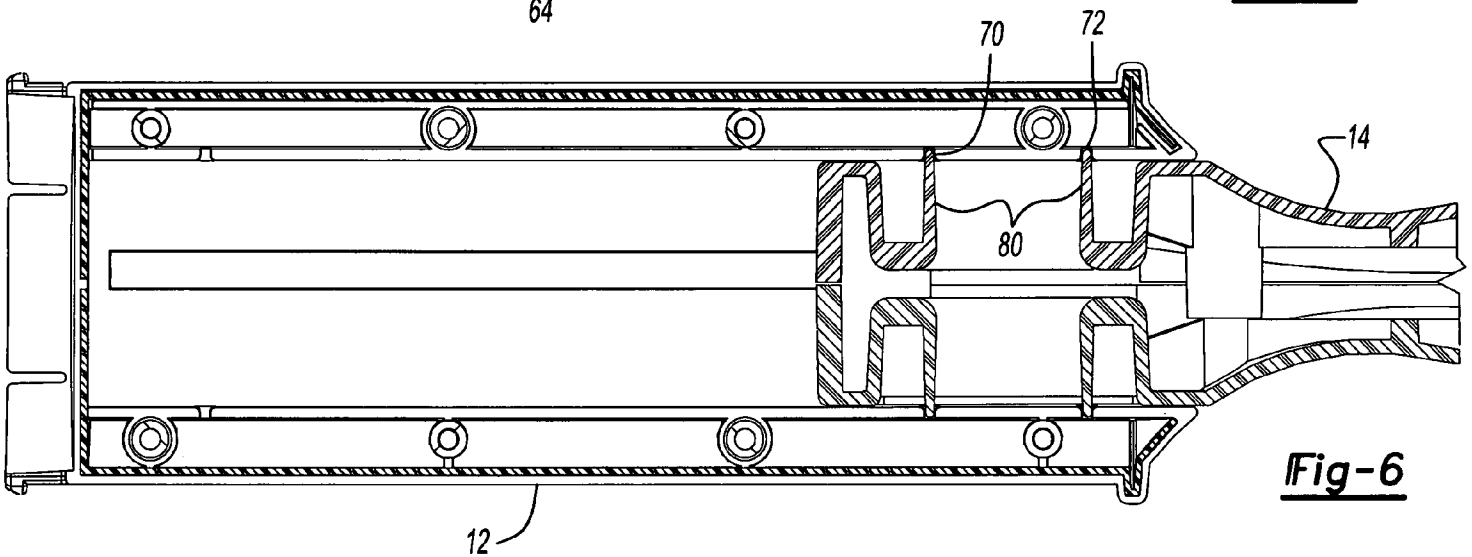
FIG. 6 is a fragmentary longitudinal sectional view illustrating the preferred embodiment of the present invention and with the handle in its first or extended position.

The cooperation between the guides 71 and 73 and the slots 56 and 58 on the lint roller support 12 enables the handle 14 to be axially slidably mounted to the lint roller support 12 between a first or extended position, illustrated in FIGS. 2 and 6, and a second or retracted position, illustrated in FIGS. 1 and 5. In its extended position, the handle 14 protrudes outwardly from the end 20 of the lint roller support 12 so that the handle 14 may be easily grasped and manipulated by the user when use of the lint roller assembly is desired. Conversely, in its second or retracted position (FIGS. 1 and 5), the handle 14 is at least partially contained within the interior of the lint roller support 12 for compact storage and/or transportation.

With reference now particularly to FIGS. 4 and 6, at least one, and preferably a pair of locking tabs 80 are formed on the lint roller handle 14. When the handle 14 is moved to its first or extended position (FIG. 6), the locking tabs 80 engage lock recesses 70 and 72 in the support 12 in order to releasably retain the handle 14 in its extended or first position. However, when use of the lint roller assembly is no longer desired, the handle 14 may be easily unlocked relative to the lint roller support 12 by applying a sufficient axial force on the handle 12 relative to the lint roller support 12 to flex the locking tabs 80 inwardly and allow the handle 14 to be moved to its second or retracted position.

From the foregoing, it can be seen that the present invention provides a lint roller holder assembly which enables compact storage, display and/or transportation of the lint roller holder assembly when use of the lint roller assembly is not desired. Having described my invention, however, many modifications thereto will become apparent to those skilled in the art to which it pertains without deviation from the spirit of the invention as defined by the scope of the appended claims.

I claim:

1. A lint roller holder assembly comprising:

a lint roller support having an outer cylindrical outer surface, an elongated handle, said handle being axially slidably mounted to said lint roller support between a first position in which said handle extends axially outwardly from one end of said lint roller support, and a second position in which said handle is at least partially contained within an interior of said lint roller support, means for locking said handle in said first position, wherein said locking means comprises a flexible tab on said handle, said tab engaging a recess on said roller support when said handle is in said first position.

2. The invention as defined in claim 1 wherein said lint roller support includes a pair of diametrically opposed longitudinally extending slots, said handle comprising a pair of spaced outwardly extending guides, each guide being slidably mounted in one of said slots.

3. The invention as defined in claim 1 wherein said lint roller support comprises a pair of semicircular sections, said sections being attached together.

4. The invention as defined in claim 3 wherein each lint roller section is substantially identical to the other lint roller section.

5. The invention as defined in claim 3 wherein said lint roller support sections are constructed of a plastic material.

6. The invention as defined in claim 3 wherein each lint roller support section comprises a pair of spaced apart and parallel sides, each lint roller support section having at least one pin adjacent one side and at least one socket adjacent the other side, said pin(s) engaging said socket(s) when said lint roller support sections are secured together.

7. The invention as defined in claim 1 wherein said handle comprises a pair of sections, said sections being secured together.

8. The invention as defined in claim 7 wherein each handle section is substantially identical to the other handle section.

9. The invention as defined in claim 7 wherein said handle sections are constructed of a plastic material.

10. The invention as defined in claim 7 wherein each handle section comprises a pair of spaced apart and parallel sides, each handle section having at least one pin adjacent one side and at least one socket adjacent the other side, said pin(s) engaging said socket(s) when said handle sections are secured together.

11. The invention as defined in claim 1 wherein said lint roller support includes a plurality of flexible fingers dimensioned to entrap a tubular and cylindrical lint roller on said lint roller support, said lint roller support rotatably supporting said lint roller.

* * * * *